US009979150B2

(12) United States Patent
Hwang et al.

(10) Patent No.: US 9,979,150 B2
(45) Date of Patent: May 22, 2018

(54) SOCKET PIN AND SEMICONDUCTOR PACKAGE TEST SYSTEM

(71) Applicant: Samsung Electronics Co., Ltd., Suwon-si, Gyeonggi-do (KR)

(72) Inventors: Soongeol Hwang, Asan-si (KR); Hyunguen Iy, Asan-si (KR)

(73) Assignee: SAMSUNG ELECTRONICS CO., LTD. (KR)

( * ) Notice: Subject to any disclaimer, the term of this patent is extended or adjusted under 35 U.S.C. 154(b) by 0 days. days.

(21) Appl. No.: 15/368,562

(22) Filed: Dec. 2, 2016

(65) Prior Publication Data

US 2017/0162991 A1 Jun. 8, 2017

(30) Foreign Application Priority Data

Dec. 4, 2015 (KR) ..... 10-2015-0172569

(51) Int. Cl.

| | |
|---|---|
| ***H01R 13/60*** | (2006.01) |
| ***H01R 33/74*** | (2006.01) |
| ***H01R 12/70*** | (2011.01) |
| ***H01R 12/71*** | (2011.01) |
| ***H01R 13/24*** | (2006.01) |
| ***H01R 12/58*** | (2011.01) |
| *H01R 12/52* | (2011.01) |

(52) U.S. Cl.

CPC ..... *H01R 33/74* (2013.01); *H01R 12/58* (2013.01); *H01R 12/7076* (2013.01); *H01R 12/716* (2013.01); *H01R 13/2407* (2013.01); *H01R 13/2492* (2013.01); *H01R 12/526* (2013.01); *H01R 2201/20* (2013.01)

(58) Field of Classification Search

CPC ..... H01R 33/74; H01R 12/526; H01R 12/58; H01R 2201/20; H01R 13/2492; H01R 12/716; H01R 13/2407; H01R 12/7076; G01R 1/0433; H02J 15/00

USPC ..... 439/533

See application file for complete search history.

(56) References Cited

U.S. PATENT DOCUMENTS

| | | | | |
|---|---|---|---|---|
| 3,934,343 | A * | 1/1976 | Witecki | B43L 9/24 30/310 |
| 5,748,007 | A | 5/1998 | Gaschke | |
| 5,766,021 | A | 6/1998 | Pickles et al. | |
| 6,064,217 | A | 5/2000 | Smith | |
| 6,267,603 | B1 | 7/2001 | Yamamoto et al. | |
| 7,042,238 | B2 | 5/2006 | Tani | |
| 9,046,568 | B2 | 6/2015 | Ho et al. | |

(Continued)

FOREIGN PATENT DOCUMENTS

| | | | |
|---|---|---|---|
| JP | 4304699 | B2 | 7/2009 |
| JP | 4657731 | B2 | 3/2011 |
| KR | 101273550 | B1 | 6/2013 |

*Primary Examiner* — Jean F Duverne

(74) *Attorney, Agent, or Firm* — Renaissance IP Law Group LLP

(57) ABSTRACT

A socket pin for electrically connecting a semiconductor substrate to a test substrate, comprising: a pin head; a pin body configured to support the pin head; and a length adjusting part provided below the pin body; wherein: the length adjusting part comprises at least a portion protruding from the pin body and a resilient structure; and the length adjusting part is movable to change a length of the portion protruding from the pin body as the resilient structure distorts.

17 Claims, 14 Drawing Sheets

(56) References Cited

U.S. PATENT DOCUMENTS

| | | | | |
|---|---|---|---|---|
| 2004/0070414 | A1* | 4/2004 | Tani | G01R 1/0433<br>324/756.02 |
| 2011/0057676 | A1 | 3/2011 | Ho et al. | |
| 2014/0091824 | A1* | 4/2014 | Fledell | H02J 15/00<br>324/755.11 |

* cited by examiner

SOCKET PIN AND SEMICONDUCTOR PACKAGE TEST SYSTEM

CROSS-REFERENCE TO RELATED APPLICATIONS

This U.S. non-provisional patent application claims priority under 35 U.S.C. § 119 to Korean Patent Application No. 10-2015-0172569, filed on Dec. 4, 2015, in the Korean Intellectual Property Office, the entire contents of which are hereby incorporated by reference.

BACKGROUND

Embodiments relate to a socket pin and a semiconductor package test system including the same.

Various test steps are performed to examine whether there is a failure in a fabricated semiconductor package. By performing the test steps, it is possible to maintain reliability of the semiconductor package. In particular, a burn-in test, one of the test steps, is performed at an initial stage of the test process. To perform the burn-in test, a semiconductor package is mounted on a test socket, and the test socket with the semiconductor package is loaded on a test substrate.

SUMMARY

Some embodiments include a socket pin for electrically connecting a semiconductor substrate to a test substrate, comprising: a pin head, a pin body configured to support the pin head and a length adjusting part provided below the pin body, wherein the length adjusting part comprises at least a portion protruding from the pin body and the length adjusting part is movable to change a length of the portion protruding from the pin body.

Some embodiments include a semiconductor package test system, comprising: a test substrate having a top surface, on which a recess region is formed; and a test socket provided on the test substrate and configured to receive a semiconductor package; wherein the test socket comprises: a base comprising a first through hole; and a socket pin inserted in the first through hole to electrically connect the recess region of the test substrate to the semiconductor package, wherein the socket pin comprises a length adjusting part that is movable to adjust a length of the socket pin based on a height of the recess region of the test substrate.

Some embodiments include A socket pin for electrically connecting a semiconductor substrate to a test substrate, comprising: a pin head; a pin body configured to support the pin head; a length adjusting part provided below the pin body; and a supporting part connected to the pin body; wherein: the length adjusting part comprises at least a portion extending through the pin body; and the length adjusting part is movable within the supporting part to change a length of the socket pin.

BRIEF DESCRIPTION OF THE DRAWINGS

Embodiments will be more clearly understood from the following brief description taken in conjunction with the accompanying drawings. The accompanying drawings represent non-limiting, example embodiments as described herein.

DETAILED DESCRIPTION

Embodiments will now be described more fully hereinafter with reference to the accompanying drawings, in which particular embodiments are shown.

Figure 1A:
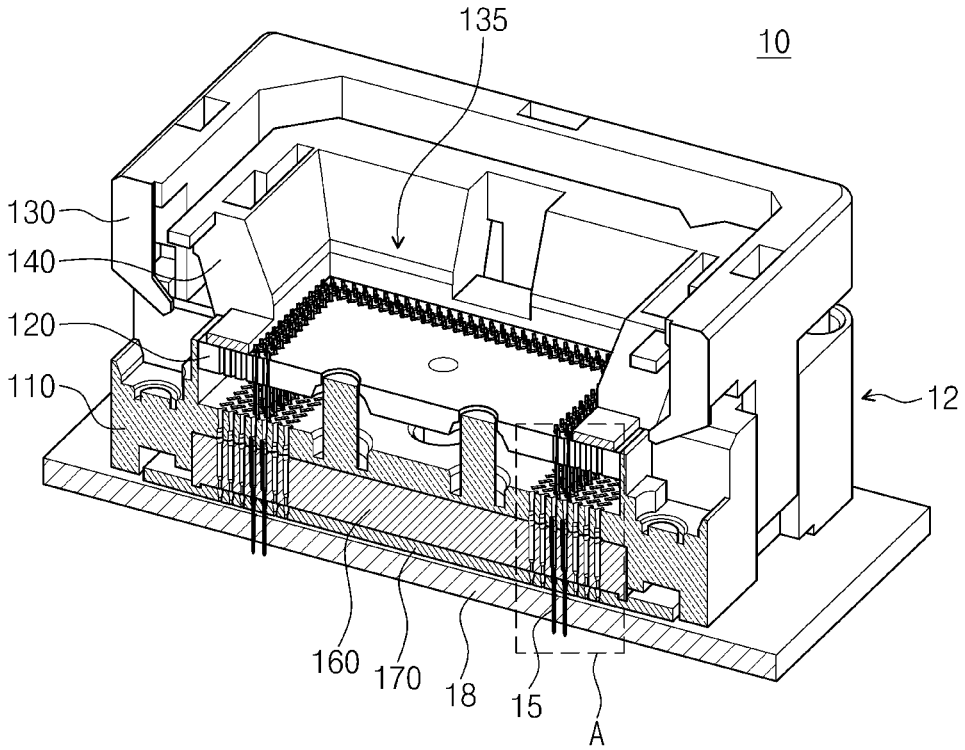
FIG. 1A is a sectional view illustrating a semiconductor package test system.
Figure 1B:
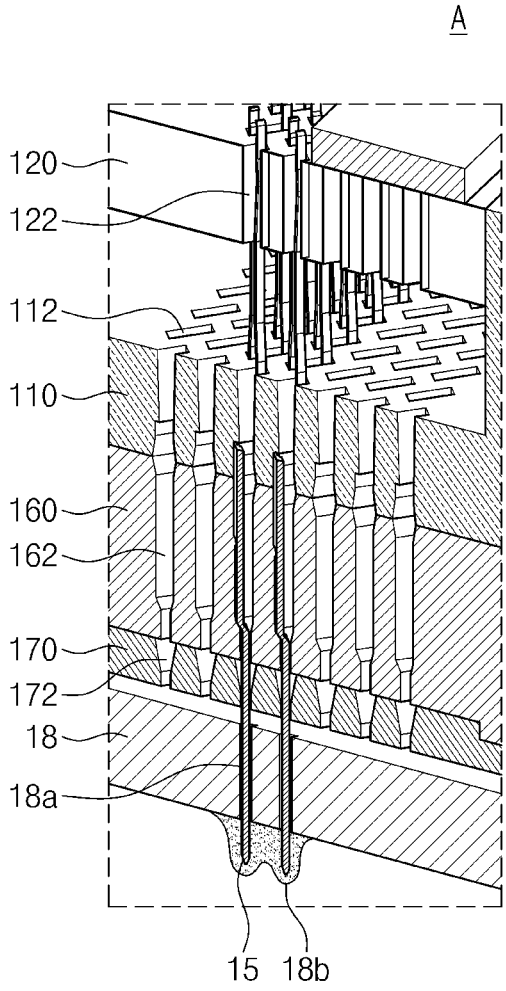
FIG. 1B is an enlarged view illustrating a portion 'A' of FIG. 1A.
Figure 2:
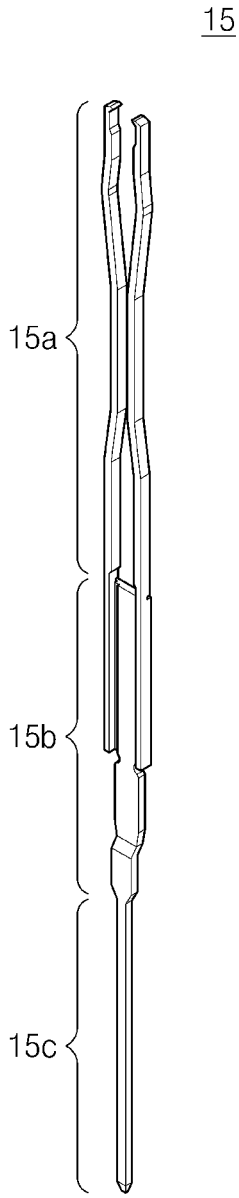
FIG. 2 is a diagram illustrating a socket pin of FIGS. 1A and 1B.

FIG. 1A is a sectional view illustrating a semiconductor package test system, and FIG. 1B is an enlarged view illustrating a portion 'A' of FIG. 1A. In FIG. 1B, a portion of the semiconductor package test system is exaggerated or omitted to clearly show a connection structure of a socket pin 15. FIG. 2 is a diagram illustrating a socket pin 15 of FIGS. 1A and 1B. A semiconductor package test system 10 may include a test socket 12 and a test substrate 18. The test socket 12 may be provided on the test substrate 18 to test electric performance of a semiconductor substrate P (e.g., see FIG. 3).

Referring to FIGS. 1A, 1B, and 2, the test socket 12 may include a base 110, a slider 120, a cover 130, an adaptor 140, a socket pin 15, a stopper 160, and a lead guide 170. The base 110 may be provided on the test substrate 18 to define a space 135 containing the semiconductor substrate P. The base 110 may have first through holes 112, and the socket pins 15 may be inserted into the first through holes 112. The slider 120 may be coupled to the base 110 and may have second through holes 122, and the socket pins 15 may be inserted into the second through holes 122. The slider 120 may be configured to align the socket pin 15. As an example, the socket pin 15 (e.g., see FIG. 2) may include a pin head 15*a* protruding upward from the second through holes 122, and a position of the slider 120 may be changed to align the socket pin 15. For example, through holes 112, 122, 162, 172, 18*a* may be provided to have widths greater than that of the socket pin 15. By moving the slider 120, the socket pin 15 may be changed to be aligned. The cover 130 may be coupled to a top portion of the base 110. The adaptor 140 may be provided in the cover 130 and may be used to guide and contain the semiconductor substrate P in the space 135. The adaptor 140 may be shaped like a rectangular ring and may have inclined surfaces. The adaptor 140 may be configured to guide the semiconductor substrate P to the space 135.

The socket pin 15 may be configured to connect the semiconductor substrate P electrically with the test substrate 18. The socket pin 15 may include opposite end portions, which are connected to the test substrate 18 and the semiconductor substrate P, respectively. For example, the pin head 15*a* of the socket pin 15 may be connected to the semiconductor substrate P, and a pin tail 15*c* of the socket pin 15 may be connected to the test substrate 18.

Referring to FIG. 2, the socket pin 15 may include a pin head 15*a*, a pin body 15*b*, and a pin tail 15*c*. The pin head 15*a*, which is an upper portion of the socket pin 15, may be electrically connectable to the semiconductor substrate P. The pin head 15*a* may have two opposite bodies. For example, the pin head 15*a* may be provided in the form of a letter 'Y'. In other examples, the pin head 15*a* may be provided in the form of a single body or in any other shape. The pin tail 15*c*, which is a lower portion of the socket pin 15, may be electrically connected to the test substrate 18. The pin body 15*b* may be configured to connect the pin head 15*a* to the pin tail 15*c*. The socket pin 15 may be provided to sequentially pass through the slider 120, the base 110, the stopper 160, the lead guide 170, and the test substrate 18 of FIG. 1A.

Referring back to FIGS. 1A and 1B, the stopper 160 may be provided in the base 110. The stopper 160 may be configured to have third through holes 162. The socket pins 15 may be inserted into the third through holes 162, and thus, the socket pins 15 may be fastened by the stopper 160. The lead guide 170 may be provided in the base 110. For example, the lead guide 170 may be provided below the stopper 160. The lead guide 170 may be configured to have fourth through holes 172. The socket pins 15 may be inserted into the fourth through holes 172. The lead guide 170 may be configured to protect the socket pin 15.

The test substrate 18 may be provided to have fifth through holes 18*a*. The socket pins 15 may be inserted into the fifth through holes 18*a*. The test substrate 18 may be, for example, a printed circuit board (PCB). The pin tail 15*c* may be provided to pass through the fifth through hole 18*a* and may have an end portion exposed by the test substrate 18. A soldering element 18*b* may be formed on the exposed end portion of the pin tail 15*c*, and thus, the socket pin 15 may be fastened to the test substrate 18.

According to the above configuration of the semiconductor package test system, the fifth through holes 18*a* of the test substrate 18 should be formed in accordance with a type of the semiconductor substrate P and a ball pitch. In addition, since the socket pin 15 is fastened to the test substrate 18 by the soldering element 18*b*, both of the socket pin 15 and the test substrate 18 may be discarded when the test process is finished.

Figure 3A:
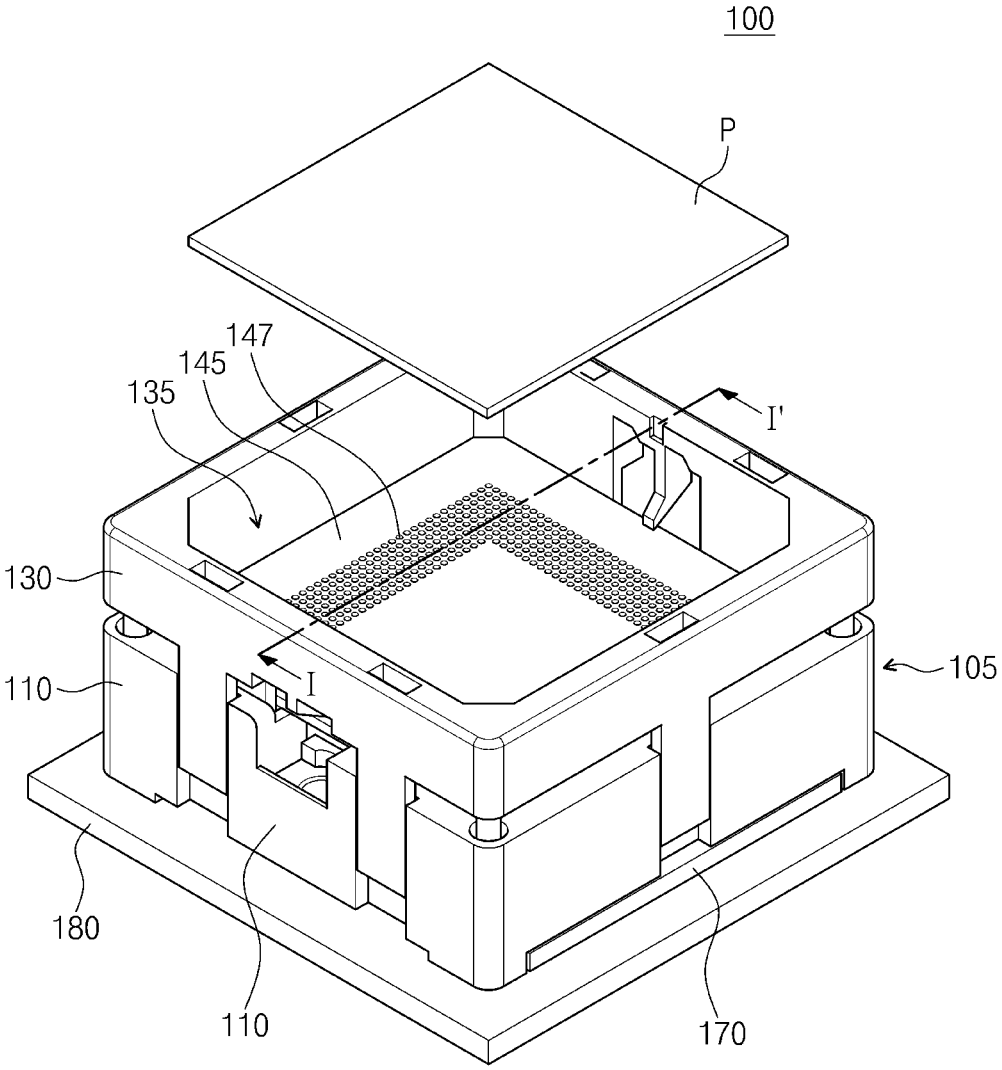
FIG. 3A is a perspective view illustrating a semiconductor package test system according to some embodiments.
Figure 3B:
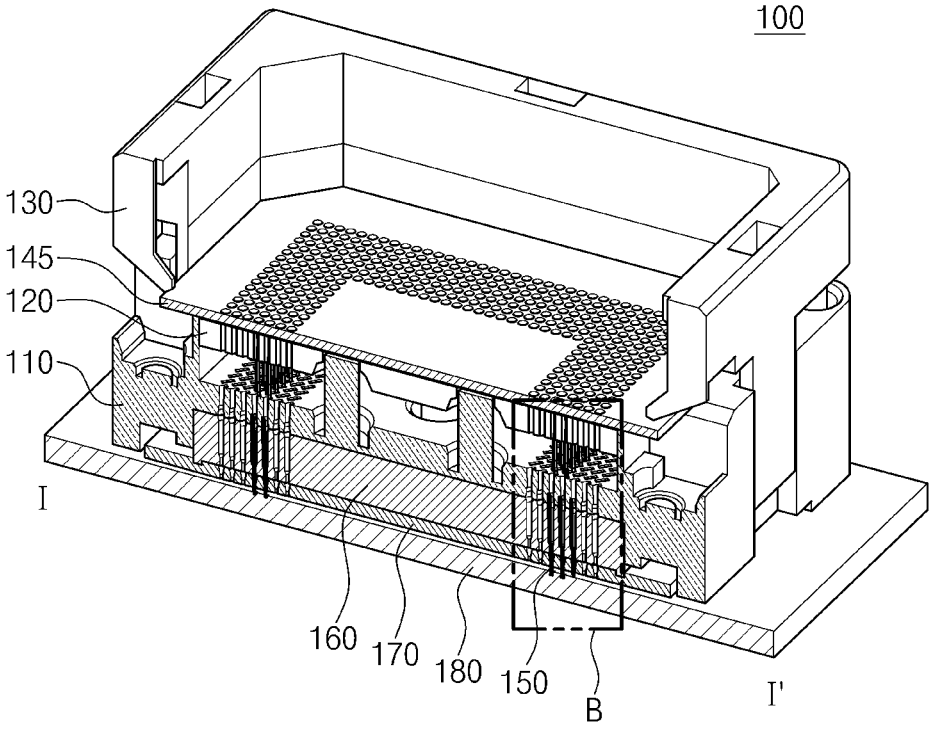
FIG. 3B is a perspective sectional view taken along line I-I' of FIG. 3A.
Figure 3C:
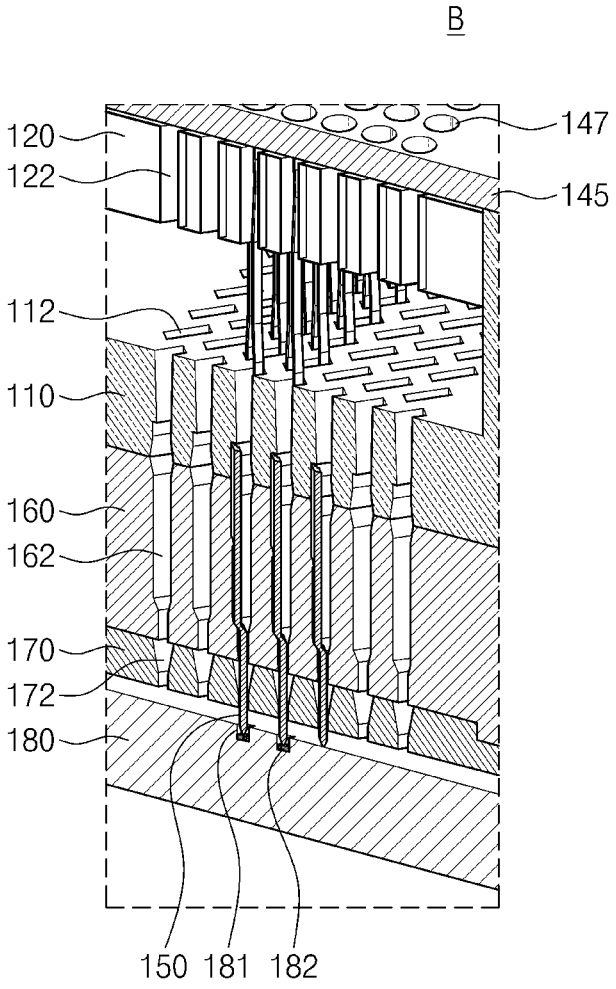
FIG. 3C is an enlarged view illustrating a portion 'B' of FIG. 3B.

FIG. 3A is a perspective view illustrating a semiconductor package test system according to some embodiments, and FIG. 3B is a perspective sectional view taken along line I-I' of FIG. 3A. FIG. 3C is an enlarged view illustrating a portion 'B' of FIG. 3B. In FIG. 3C, a portion of the semiconductor package test system is exaggerated or omitted to clearly show a connection structure of a socket pin 150. In the following description, an element previously described with reference to FIGS. 1A and 1B may be identified by a similar or identical reference number without repeating an overlapping description thereof. Although the description that follows will refer to an example in which a test socket 105 and a semiconductor package test system 100 are used to perform a burn-in test, other embodiments are not limited to the burn-in test. In addition, the description that follows will refer to a ball grid array (BGA)-type semiconductor package with solder balls, but other embodiments may be applicable to other types of semiconductor packages (e.g., TSOP or LGA).

A semiconductor package test system 100 may include a test socket 105 and a test substrate 180. The test socket 105 may be provided on the test substrate 180 and may be used to test electric performance of the semiconductor substrate P. The semiconductor substrate P may be a packaged substrate, a packaged semiconductor device or system, or the like. The semiconductor substrate P may include first terminals (e.g., see P1 of FIG. 4B) provided on a bottom surface thereof, and the test substrate 180 may include second terminals 182. Each of the first terminals P1 may be shaped like a ball, and each of the second terminals 182 may be shaped like a pad; however, in other embodiments, the first terminals P1 and the second terminals 182 may have other forms.

The test socket 105 may include a base 110, a slider 120, a cover 130, a ball guide plate 145, a socket pin 150, a stopper 160, and a lead guide 170. The base 110 may be provided on the test substrate 18 to define a space 135 to contain the semiconductor substrate P. The base 110 may be provided to have first through holes 112, and the socket pins 150 may be inserted into the first through holes 112. The slider 120 may be coupled to the base 110 and may have second through holes 122, and the socket pins 150 may be inserted into the second through holes 122. The slider 120 may be configured to align the socket pin 150. The cover 130 may be coupled to a top portion of the base 110. The cover 130 may have a hollow structure. The cover 130 may be connected to the base 110 and may be used to operate the slider 120. The ball guide plate 145 may be provided on the slider 120. The ball guide plate 145 may include ball guide holes 147, in which the first terminals P1 of the semiconductor substrate P may be provided. Since the first terminals P1 may be provided in the ball guide holes 147, the semiconductor substrate P may be stably disposed in the space 135. Since the ball guide holes 147 need not be limited by a size of the semiconductor substrate P, various sizes of the semiconductor substrate P can be loaded on the ball guide holes 147.

Figure 4A:
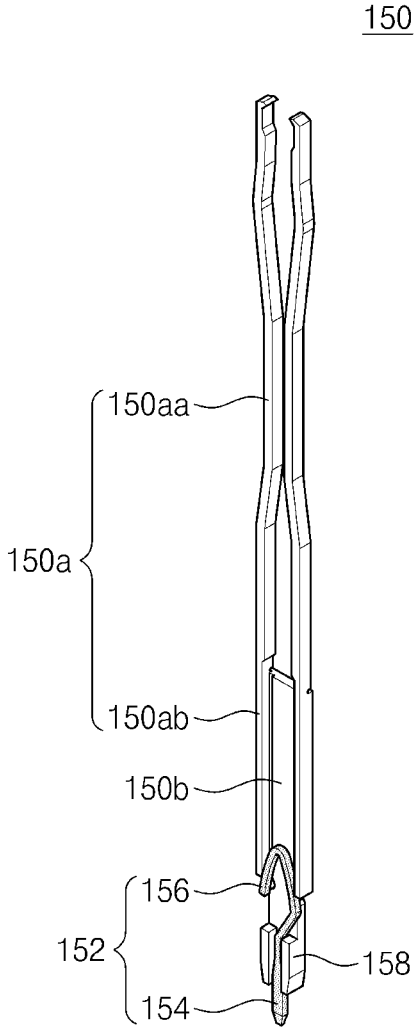
FIG. 4A is a perspective view illustrating a socket pin of FIGS. 3A to 3C.
Figure 4B:
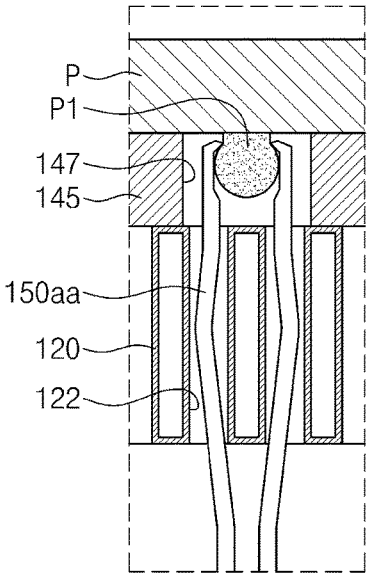
FIG. 4B is a sectional view illustrating a pin head of FIG. 4A connected to a first terminal.
Figure 4C:
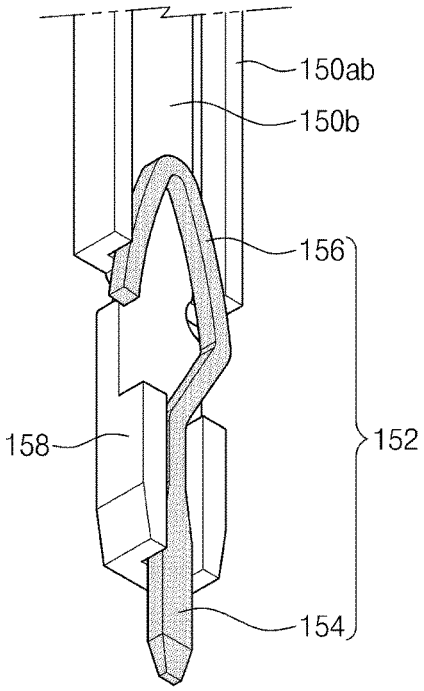
FIG. 4C is an enlarged view of a length adjusting part of FIG. 4A.

FIG. 4A is a perspective view illustrating the socket pin 150 of FIGS. 3A to 3C. FIG. 4B is a sectional view illustrating a pin head 150*a* of FIG. 4A connected to the first terminal P1, and FIG. 4C is an enlarged view of a length adjusting part 152 of FIG. 4A. Referring to FIGS. 4A to 4C, the socket pin 150 may include a pin head 150*a*, a pin body 150*b*, a length adjusting part 152, and a supporting part 158. The pin head 150*a* may be an upper portion of the socket pin 150 and may be electrically connectable to the semiconductor substrate P. As an example, the pin head 150*a* may be configured to be placed in contact with the first terminal P1 of the semiconductor substrate P. The pin head 150*a* may have two opposite bodies. For example, the pin head 150*a* may be provided in the form of a letter 'Y', and the first terminal P1 may be inserted into a region between the two bodies. However, other embodiments are not limited thereto, and the pin head 150*a* may be provided in the form of a single body or in any other shape. The pin head 150*a* may include a head part 150*aa* and pin head supporting parts 150*ab*. The head part 150*aa* may be configured to contact a side surface of the first terminal P1. In other words, the socket pin 150 may be of a pinch type that, when moved to surround the first terminal P1, may be compressed or otherwise deformed to contact the first terminal P1. The pin head supporting parts 150*ab* may be overlapped with the pin body 150*b*. The pin head supporting parts 150*ab* may be coupled to the pin body 150*b* to support the head part 150*aa*. For example, the pin head supporting parts 150*ab* may have a structure extending in a height direction. The pin body 150*b* may be configured to support the pin head 150*a*.

The length adjusting part 152 may be provided below the pin body 150*b*. The length adjusting part 152 may be a lower portion of the socket pin 150 and may be electrically connectable to the test substrate 180 (e.g., second terminals 182). Furthermore, the supporting part 158 may be configured to be a part of the pin body 150*b*. The length adjusting part 152 may include at least a portion protruding outwardly from the pin body 150*b* and may be configured in such a way that a length thereof from the bottom surface of the pin body 150*b* can be changed. Accordingly, a total length of the socket pin 150 can be changed. The length adjusting part 152 may include a first portion 154 and a second portion 156. For example, the first portion 154 may be a lower portion of the length adjusting part 152, and the second portion 156 may be an upper portion of the length adjusting part 152. The first portion 154 may include at least a portion protruding outwardly from the bottom surface of the pin body 150*b*. The second portion 156 may be connected to the first portion 154 and may be inserted into the pin body 150*b*. For example, the second portion 156 may extend from the first portion 154. The second portion 156 may be provided in the form of a hook. If a pressure is applied to the socket pin 150 in its length direction, the hook-shaped portion of the second portion 156 may be inserted into the pin head supporting parts 150*ab*. The second portion 156 may be a rigid body (e.g., metal or metal alloy). Accordingly, if the second portion 156 is inserted into the pin head supporting parts 150*ab*, a resistant force pushing the second portion 156 in a direction out of the pin head supporting parts 150*ab* may be applied to the second portion 156 and hence, the length adjusting part 152.

The supporting part 158 may be provided on a lower portion of the pin body 150*b*. The supporting part 158 may be configured to support the length adjusting part 152. As an example, the supporting part 158 may extend in a length direction of the socket pin 150, and the first portion 154 of the length adjusting part 152 may be inserted in the supporting part 158. Since the supporting part 158 supports the first portion 154 in the length direction of the socket pin 150, movement of the first portion 154 in a horizontal direction may be restricted. Accordingly, it is possible to more easily align the socket pin 150 to the test substrate 180. However, in certain embodiments, the supporting part 158 may be omitted. The socket pin 150 may be provided to sequentially pass through the slider 120, the base 110, the stopper 160, the lead guide 170, and the test substrate 180.

Referring back to FIGS. 3A to 3C, the stopper 160 may be provided in the base 110. The stopper 160 may be provided to have third through holes 162. The socket pins 150 may be inserted into the third through holes 162, and thus, the socket pins 150 may be fastened by the stopper 160. The lead guide 170 may be provided in the base 110. The lead guide 170 may be provided below the stopper 160. The lead guide 170 may include fourth through holes 172. The socket pins 150 may be inserted in the fourth through holes 172. The lead guide 170 may be configured to protect the socket pin 150.

A top surface of the test substrate 180 may be provided to have a recess region 181. The second terminal 182 may be provided in the recess region 181. For example, the top surface of the test substrate 180 may be formed to have a difference in height. A magnitude of pressure applied to the socket pin 150 may be dependent on a height of the top surface of the test substrate 180 that is in contact with each socket pin 150. Accordingly, it is possible to allow each socket pin 150 to have a variable length. That is, the length of the socket pins 150 may vary according to a contour of the test substrate 180 and, in particular, structures of the test substrate 180 contacting the socket pins 150. Since the resistant force is applied to the length adjusting part 152, the socket pin 150 may be restored to its initial length when the pressure applied to the socket pin 150 is removed. Accordingly, if the test process is finished, only the test substrate 180 may be discarded, and the socket pin 150 may be re-used. In addition, in some embodiments, one or more of the recess regions 181 do not include a through hole extending through the test substrate 180. As a result, electrical connections within the test substrate 180 and/or on an opposite side of the substrate may be more easily routed.

Figure 5A:
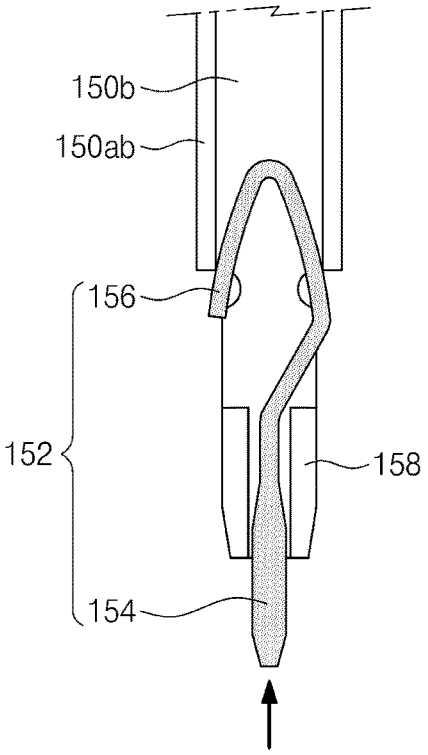
FIGS. 5A and 5B are diagrams schematically illustrating a reduction in length of a socket pin, which occurs when the socket pin is in contact with a test substrate.
Figure 5B:
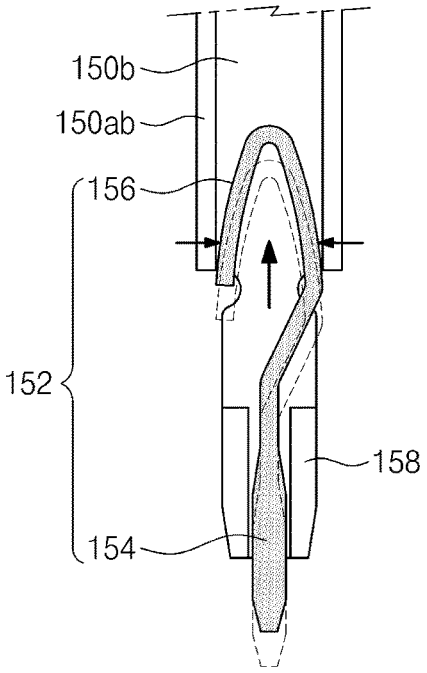
Figure 6A:
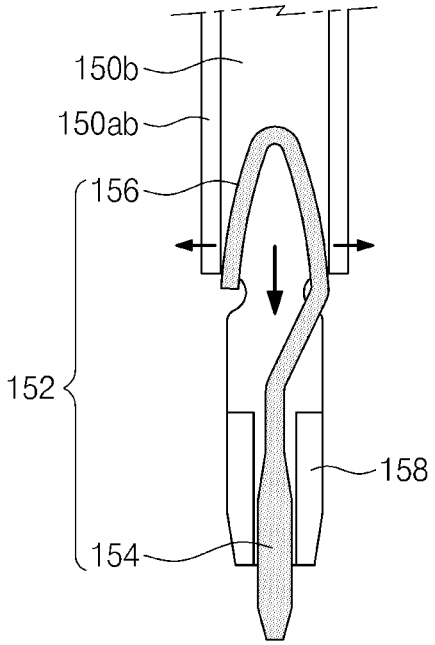
FIGS. 6A and 6B are diagrams schematically illustrating restoration of the socket pin to an initial length, which occurs when the socket pin is separated from the test substrate.
Figure 6B:
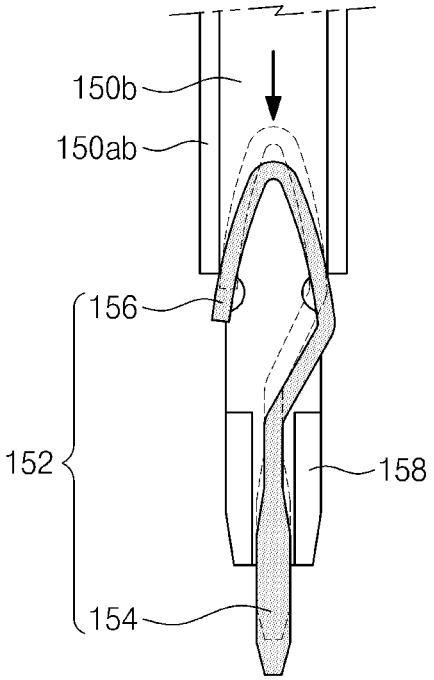

FIGS. 5A and 5B are diagrams schematically illustrating a reduction in length of a socket pin 150, which occurs when the socket pin 150 is in contact with the test substrate 180. FIGS. 6A and 6B are diagrams schematically illustrating restoration of the socket pin 150 to an initial length, which may occur when the socket pin 150 is separated from the test substrate 180. In other words, FIGS. 5A and 5B illustrate a process, in which a distance between the bottom surface of the pin body 150*b* and the length adjusting part 152 is reduced, and FIGS. 6A and 6B illustrate a process, in which the distance between the bottom surface of the pin body 150*b* and the length adjusting part 152 is restored. Referring to FIGS. 5A and 5B, in the case where a pressure is applied to the length adjusting part 152 by the test substrate 180, the length adjusting part 152 may be upwardly moved along its length direction. In some embodiments, the length adjusting part 152 may distort. Here, the hook-shaped portion of the second portion 156 may be inserted between pin head supporting part 150*ab* and is compressed. However, when the second portion 156 is a rigid body and is forcedly inserted between the pin head supporting parts 150*ab*, a resistant force may be applied to the second portion 156 from the pin head supporting parts 150*ab* as the second portion 156 distorts. For example, the resistant force may be restoring force. Accordingly, referring to FIGS. 6A and 6B, if the pressure from the test substrate 180 is removed, the length adjusting part 152 may be restored to its initial position by a resistant force applied to the second portion 156. Although a particular configuration of a rigid structure has been used as an example, in other embodiments, any rigid structure that results in a force applied to the length adjusting part 152 in a direction that returns the length adjusting part 152 to its initial position may be used.

Although not shown, the test socket 105 may further include a latch (not shown). The latch (not shown) may be configured to immobilize the semiconductor substrate P provided in the base 110. In certain embodiments, the test socket 105 may include an adaptor 140. Also, some elements of the test socket 105 may be omitted or modified.

The socket pin 150 may be used for transmission of test signals. According to some embodiments, the socket pin 150 may be configured to have an adjustable length and to be detachable from the test substrate 180. Also, it may be unnecessary to form fifth through holes (e.g., see 18*a* of FIG. 1B) in the test substrate 180, and since the second terminals 182 are formed in accordance with positions of the socket pins 150, it is possible to simplify a process of fabricating the test substrate 180. In addition, since there is no necessity to connect the socket pins 150 to the test substrate 180, it is possible to re-use the socket pins 150. Furthermore, since the socket pin 150 has an adjustable length, the socket pin 150 can be used to perform a test process on various types of semiconductor devices.

Figure 7A:
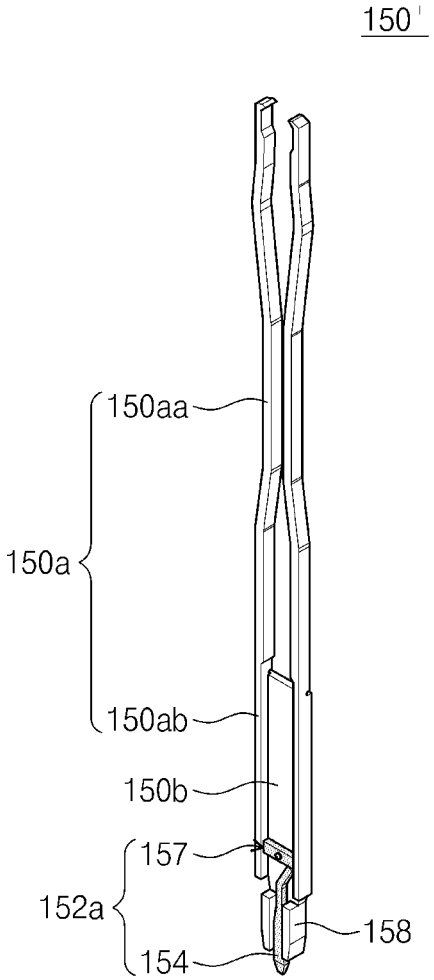
FIG. 7A is a perspective view illustrating a socket pin according to some embodiments.
Figure 7B:
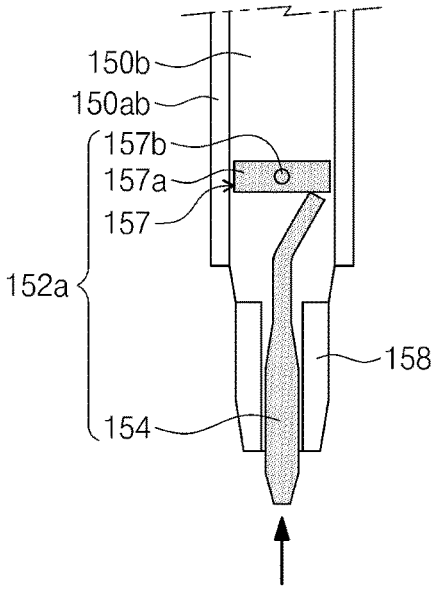
FIGS. 7B and 7C are diagrams schematically illustrating a process of changing a length of the socket pin of FIG. 7A.
Figure 7C:
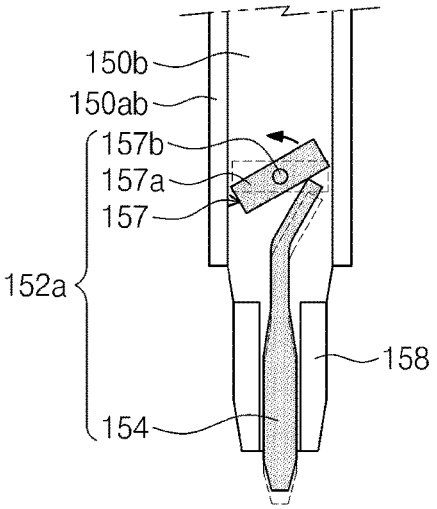

FIG. 7A is a perspective view illustrating a socket pin 150' according to some embodiments. FIGS. 7B and 7C are diagrams schematically illustrating a process of changing a length of the socket pin 150' of FIG. 7A. In the following description of the socket pin 150', an element previously described with reference to FIGS. 4A and 4C may be identified by a similar or identical reference number without repeating an overlapping description thereof.

Referring to FIGS. 7A to 7C, the length adjusting part 152*a* may have the first portion 154 and a rotation member 157. The first portion 154 may include at least a portion protruding from the bottom surface of the pin body 150*b*. For example, a lower portion of the first portion 154 may protrude from the bottom surface of the pin body 150*b*. The rotation member 157 may be coupled to the pin body 150*b*. The rotation member 157 may be provided to face the first portion 154.

In some embodiments, the rotation member 157 may include the rotation bar 157*a* coupled to the pin body 150*b* and the rotation axis 157*b* provided at substantially a center of the rotation bar 157*a*. The rotation bar 157*a* may be configured to rotate about the rotation axis 157*b*. An end portion of the first portion 154 may be provided to face a side of the rotation bar 157*a*.

In a particular example, the rotation member 157 may be rotatably attached to the pin body 150*b* such that when rotated as illustrated in FIG. 7C, the rotation member 157 applies a force to the first portion 154 in a direction opposite to the rotation. Accordingly, in the case where a pressure from the test substrate 180 is applied to the first portion 154, the first portion 154 may be upward moved to cause rotation of the rotation bar 157*a*. This may lead to a reduction in total length of the socket pin 150'. By contrast, in the case where the pressure is removed, the rotation bar 157*a* and the first portion 154 may be restored to their initial state. To enhance the restoration of the rotation bar 157*a*, the rotation bar 157*a* may be provided to have a weight greater than that of the first portion 154. A material, size, or weight of the rotation bar 157*a* may be changed to more effectively control a length of the length adjusting part 152*a*. Although a particular configuration of a rotating structure has been used as an example, in other embodiments, any rotating structure that will apply a force to the first portion 154 in a direction that returns the first portion 154 to its initial position may be used.

Figure 8A:
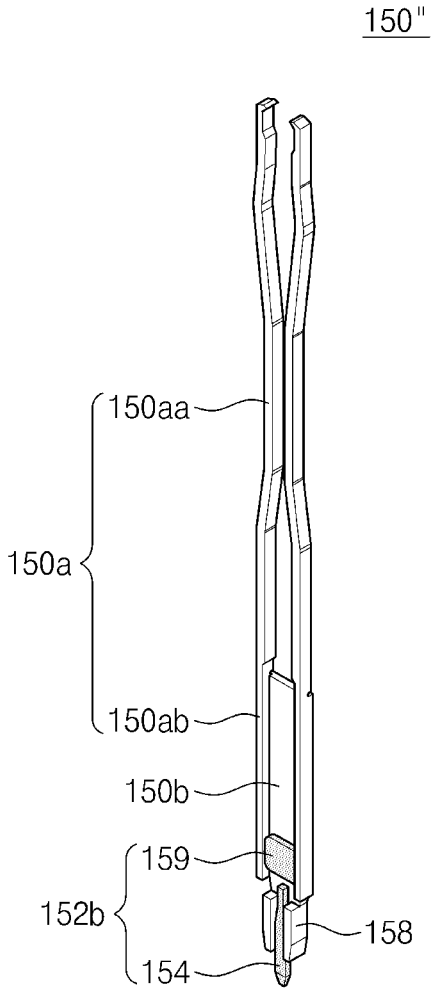
FIG. 8A is a perspective view illustrating a socket pin according to some embodiments.
Figure 8B:
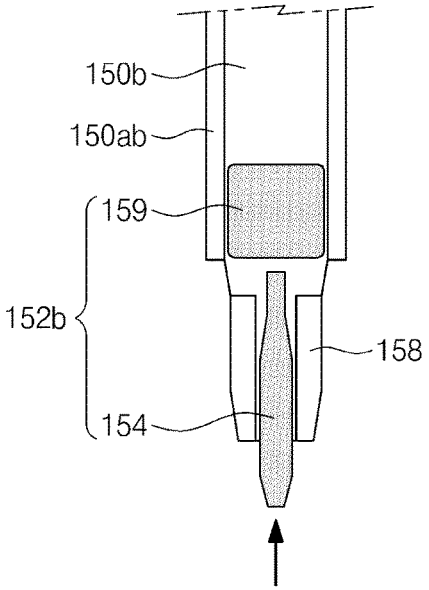
FIGS. 8B and 8C are diagrams schematically illustrating a process of changing a length of the socket pin of FIG. 8A.
Figure 8C:
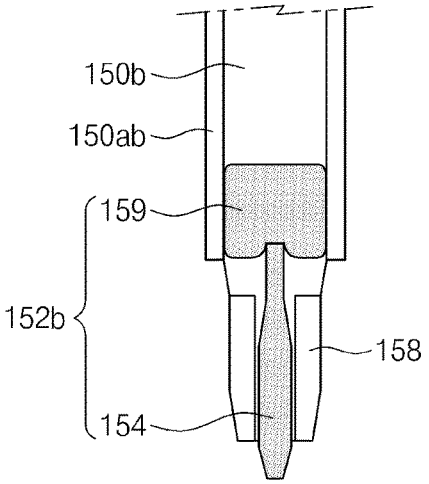

FIG. 8A is a perspective view illustrating a socket pin 150" according to some embodiments. FIGS. 8B and 8C are diagrams schematically illustrating a process of changing a length of the socket pin 150" of FIG. 8A. In the following description of the socket pin 150", an element previously described with reference to FIGS. 4A and 4C may be identified by a similar or identical reference number without repeating an overlapping description thereof.

Referring to FIGS. 8A to 8C, the length adjusting part 152*b* may have the first portion 154 and an elastic element 159. The first portion 154 may include at least a portion protruding from the bottom surface of the pin body 150*b*. For example, a lower portion of the first portion 154 may protrude from the bottom surface of the pin body 150*b*. The elastic element 159 may be coupled to the pin body 150*b*. The elastic element 159 may be provided to face the first portion 154. For example, the elastic element 159 may be formed of an insulating material; however, in other embodiments, the elastic element 159 may be formed of a conducting material, a material that conducts under pressure, or the like. If the test substrate 180 applies a pressure to an end portion of the first portion 154, the first portion 154 may be moved in an upward direction, and thus, an opposite end portion of the first portion 154 may contact and compress the elastic element 159. Accordingly, the elastic element 159 may be pushed by the first portion 154, and thus, a total length of the socket pin 150" may be reduced. In the case where there is no pressure between the first portion 154 and the elastic element 159, the elastic element 159 may be restored and the first portion 154 may be moved to its initial position. Although the first portion 154 is illustrated to have a bar shape and the opposite end portion thereof is illustrated to be in contact with the elastic element 159, the shape of the opposite end portion of the first portion 154 may be variously changed. For example, as shown in FIG. 4A, the opposite end portion of the first portion 154 may be shaped like a hook. Although a particular configuration of an elastic structure has been used as an example, in other embodiments, any elastic structure that will apply a force to the first portion 154 in a direction that returns the first portion 154 to its initial position may be used.

Although, in the above examples, the length adjusting parts 152, 152*a*, and 152*b* are described to have a resilient structure, a rotatable structure, or an elastic structure, shapes and structures of the length adjusting parts 152, 152*a*, and 152*b* may not be limited thereto in other embodiments. For example, the total length of the socket pin may be adjusted by other structures (e.g., a hinge connection structure or a pivot structure). Although the second terminals of the test substrate are described to have a recessed structure, the second terminals may be provided to have a structure protruding from the top surface of the test substrate.

According to some embodiments, forming through holes in a test substrate may not be necessary. In other words, since terminals on the test substrate are formed based on positions of socket pins, it is possible to simplify a process of fabricating the test substrate. In addition, there is no necessity to connect the socket pins to the test substrate, and thus, it is possible to re-use the socket pins. Furthermore, since the socket pin has an adjustable length, the socket pin can be used to perform a test process on various types of semiconductor devices.

While particular embodiments have been illustrated and described, it will be understood by one of ordinary skill in the art that variations in form and detail may be made therein without departing from the spirit and scope of the attached claims.

What is claimed is:

1. A socket pin for electrically connecting a semiconductor substrate to a test substrate, comprising:

a pin head including a first branch electrode and a second branch electrode and a first sliding guide and a second sliding guide connected to the first branch electrode and the second branch electrode in a first direction respectively;

a pin body configured to support the pin head, the pin body including a plate part connecting between a side of the first sliding guide and a side of the second sliding guide, a tail part connected to the plate part in the first direction, and probing guides connected to an end of the tail part in the first direction being separated from the first sliding guide and the second sliding guide; and a length adjusting part provided on the pin body, the length adjusting part including an elastic hook on the tail part and the plate part, and a probing pin connected to the elastic hook in the first direction, the probing pin disposed between the probing guides, wherein the elastic hook contacts opposite sides of the first sliding guide and the second sliding guide and slides the opposite sides of the first sliding guide and the second sliding guide to adjust a distance between a tip of probing pin and the probing guides.

2. The socket pin of claim 1, wherein the elastic hook is configured to be insertable into a space between the first sliding guide and the second sliding guide.

3. The socket pin of claim 2, wherein the elastic hook is a rigid body.

4. The socket pin of claim 1, wherein the length adjusting part further comprises a rotation member provided in the pin body to face the probing pin.

5. The socket pin of claim 4, wherein the rotation member comprises:

a rotation bar coupled to the pin body; and a rotation axis provided at a center of the rotation bar, wherein an end portion of the probing pin is provided to face a side of the rotation bar.

6. The socket pin of claim 1, wherein the length adjusting part further comprises an elastic element provided in the pin body to face the probing pin.

7. The socket pin of claim 1, wherein the probing guides are configured to support the length adjusting part.

8. The socket pin of claim 3, wherein the probing guides are configured to support the probing pin.

9. A semiconductor package test system, comprising:

a test substrate having a top surface, on which a recess region is formed; and a test socket provided on the test substrate and configured to receive a semiconductor package;

wherein the test socket comprises:

a base comprising a first through hole; and a socket pin inserted in the first through hole to electrically connect the test substrate to the semiconductor package, wherein the socket pin comprises;

a pin head including a first branch electrode and a second branch electrode and a first sliding guide and a second sliding guide connected to the first branch electrode and the second branch electrode in a first direction respectively;

a pin body configured to support the pin head, the pin body including a plate part connecting between a side of the first sliding guide and a side of the second sliding guide, a tail part connected to the plate part in the first direction, and probing guides connected to an end of the tail part in the first direction, the probing guides being separated from the first sliding guide and the second sliding guide; and a length adjusting part provided on the pin body, the length adjusting part including an elastic hook on the tail part and the plate part, and a probing pin connected to the elastic hook in the first direction, the probing pin disposed between the probing guides, wherein the elastic hook contacts opposite sides of the first sliding guide and the second sliding guide and slides the opposite sides of the first sliding guide and the second sliding guide to adjust a distance between a tip of probing pin and probing guides.

10. The semiconductor package test system of claim 9, wherein:

the socket pin comprises:

a pin head configured to contact a first terminal of the semiconductor package; and a pin body configured to support the pin head; and the length adjusting part is provided in the pin body and is in contact with a second terminal of the test substrate in the recess region.

11. The semiconductor package test system of claim 10, wherein the elastic hook is configured to be insertable a space between the first sliding guide and the second sliding guide.

12. The semiconductor package test system of claim 11, wherein the elastic hook includes a rigid body.

13. The semiconductor package test system of claim 10, wherein the pin head is configured to contact with a side of the first terminal.

14. The semiconductor package test system of claim 10, wherein the semiconductor package comprises a ball grid array (BGA) package substrate.

15. The semiconductor package test system of claim 14, wherein:

the pin head is provided in the form of a letter 'Y'; and the first terminal is a ball-shaped terminal that is insertable in the pin head.

16. A socket pin for electrically connecting a semiconductor substrate to a test substrate, comprising:

a pin head;

a pin body configured to be within the pin head and support the pin head;

a length adjusting part provided below the pin body in a lengthwise direction of the pin body, wherein the length adjusting part is partially within the pin head; and a supporting part connected to the pin body, wherein the length adjusting part comprises a portion extending through the supporting part and is movable in the lengthwise direction within the supporting part to change a length of the socket pin.

17. The socket pin of claim 16, wherein:

the length adjusting part further comprises a rotation member provided to face the portion.

* * * * *